United States Patent [19]

Orloff

[11] 4,235,157

[45] Nov. 25, 1980

[54] VOLUMETRIC METERING STUFFER WITH PRODUCT SEALS

[75] Inventor: Daniel L. Orloff, Madison, Wis.

[73] Assignee: Oscar Mayer & Co. Inc., Madison, Wis.

[21] Appl. No.: 5,788

[22] Filed: Jan. 23, 1979

Related U.S. Application Data

[63] Continuation-in-part of Ser. No. 760,860, Jan. 21, 1977, abandoned.

[51] Int. Cl.[3] ..... F01B 9/00; F16J 15/18

[52] U.S. Cl. ..... 92/140; 74/88; 74/102; 74/110; 92/168

[58] Field of Search ..... 92/140, 168, 13.1; 74/88, 102, 110; 141/156

[56] References Cited

U.S. PATENT DOCUMENTS

| | | | |
|---|---|---|---|
| 1,985,588 | 12/1934 | Tatter | 92/140 |
| 2,975,599 | 3/1961 | Bennett | 92/168 |
| 3,443,521 | 5/1969 | Stender | 92/13.1 |
| 3,473,579 | 10/1969 | Orloff | 141/156 |

*Primary Examiner*—John M. Jillions

*Attorney, Agent, or Firm*—Lockwood, Dewey, Alex & Cummings

[57] ABSTRACT

The ram housings of a volumetric metering stuffer are provided with ram seals to prevent leakage of the product being stuffed. The rams are reciprocated translatorily along substantially straight lines to prevent sidewise thrust on the seals. Cushions absorb the shock incident to the ends of the strokes of the rams and provide smooth deceleration thereof. Each ram has a clean-up cage to receive the ram when the ram is withdrawn from its housing.

5 Claims, 9 Drawing Figures

VOLUMETRIC METERING STUFFER WITH PRODUCT SEALS

This application is a continuation-in-part of application Ser. No. 760,860 filed Jan. 21, 1977, now abandoned.

This application relates, generally, to product dispensing apparatus and it has particular relation to volumetric metering stuffing devices. It constitutes an improvement over the volumetric metering stuffer disclosed in D. L. Orloff Pat. No. 3,473,579 issued Oct. 21, 1969 and assigned to the assignee of this application.

The above patent employs a pair of parallel located stuffing horns or ram housings in which are sequentially operated rams for stuffing a food product, such as meat into containers. Slidable in each horn or housing is a ram that is moved by a hydraulic operator in a sequence that is controlled by magnetic sensors located adjacent the ends of a volumetric metering passageway interconnecting the stuffing horns in which a piston is freely slidable. The hydraulic operator is initiated in action by the juxtaposition of a ferromagnetic element carried by the free piston with one of the magnetic sensors in conjunction with another magnetic sensor when a container is in position to receive the product from the respective stuffing horn.

Among the objects of this invention are: to provide a seal between each stuffing horn or ram housing and the respective ram at the end connected to the operating mechanism in order to reduce leakage therepast of the product being stuffed; to operate each ram substantially only translatorily in order to avoid sidewise thrust on the respective seal; to employ a known linkage between each ram and the operating mechanism for converting pivotal motion of the latter into translatory movement of the former; to cushion the final movement of the operator at each end of its stroke in order to provide for smooth deceleration of each ram and the operating mechanism therefor; and to provide for supporting each ram when it is withdrawn from its horn or housing for cleaning purposes.

In the drawings in which like reference numerals indicate like parts:

FIG. 7 is a detail view on enlarged scale showing the seal between the reciprocable ram and the end of the ram housing in FIG. 4;

Figures 1, 2, 3, 4:
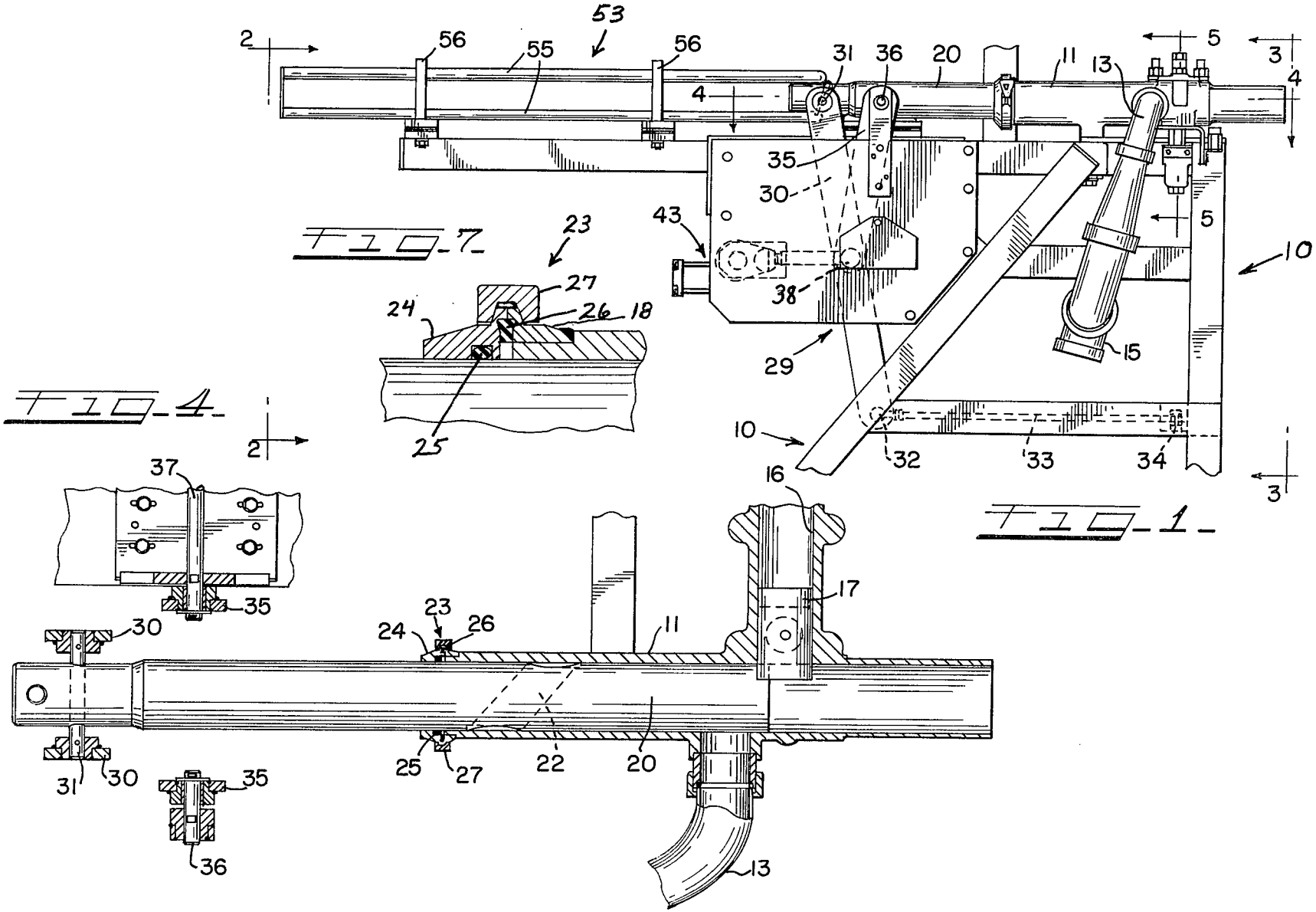
FIG. 1 is a view, in side elevation, of a volumetric metering stuffer in which this invention is embodied.
FIG. 2 is an end view on an enlarged scale of the apparatus shown in FIG. 1 taken along line 2—2 and looking from left to right.
FIG. 3 is an end view on an enlarged scale of the apparatus shown in FIG. 1 taken along line 3—3 and looking from right to left.
FIG. 4 is a horizontal fragmentary section view on an enlarged scale taken generally along line 4—4 of FIG. 1.
Figure 3:
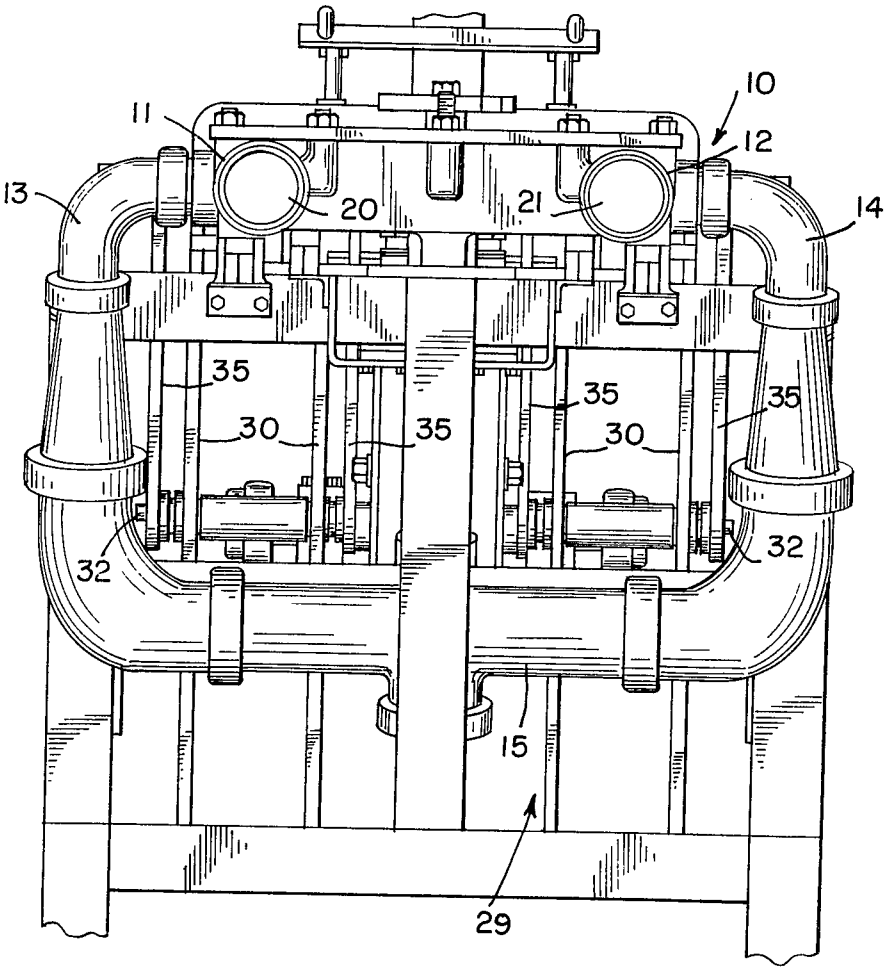
Figure 2:
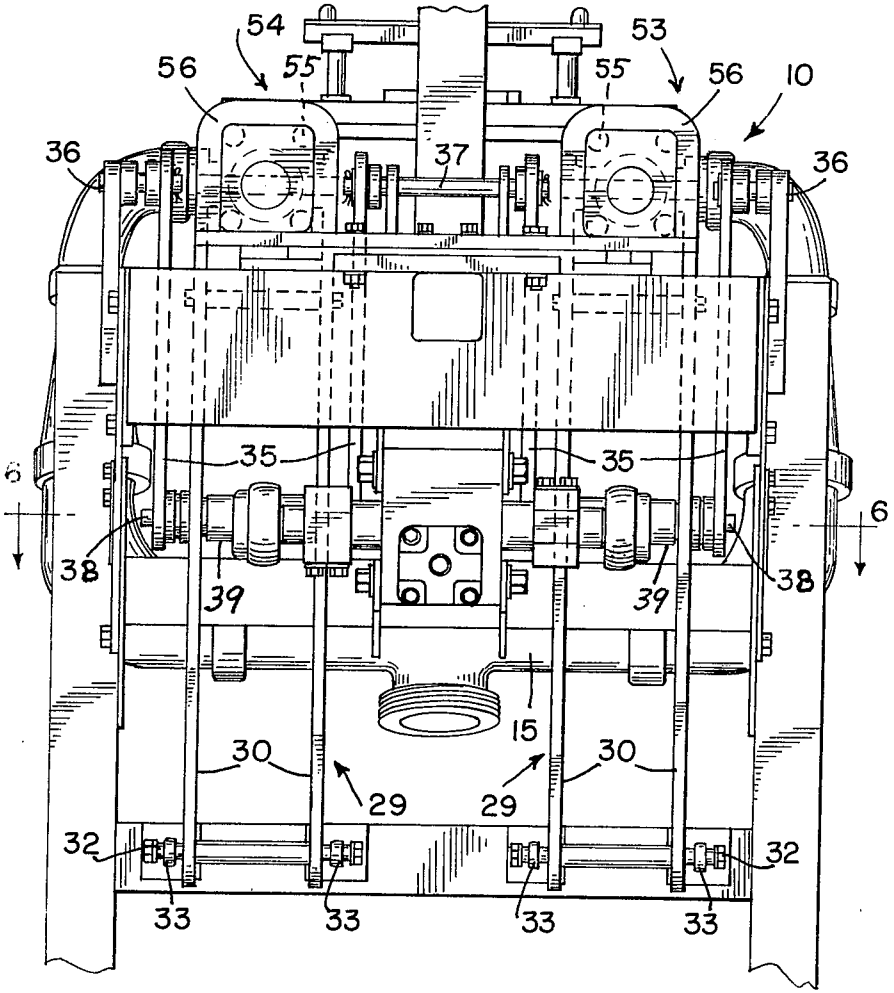

Referring to FIGS. 1, 2 and 3, reference character 10 designates, generally, a main frame formed by suitable angle uprights, braces, etc. The main frame 10 carries on top left and right stuffing horns or ram housings 11 and 12 in parallel spaced relation as described in the above patent. Connected to the left and right horns 11 and 12 are left and right supply lines 13 and 14 which are fed through a T fitting 15 from a suitable source of product under pressure to be stuffed into suitable containers, not shown. The horns 11 and 12 are interconnected by a volumetric metering passageway 16 in which there is a free piston 17 also more fully described in the above-mentioned U.S. Pat. No. 3,473,579.

Slidable in the left and right horns 11 and 12 are left and right pistons 20 and 21 each of which is provided with a cross channel, such as the cross channel 22 shown in FIG. 4, for receiving the product to be stuffed from the respective supply line 13 or 14 and directing it into the volumetric metering passageway 16. The metered product then is forced by the free piston 17 alternately into each horn 11 or 12 from which it is forced by the pistons or rams 20 and 21, respectively.

With a view to preventing leakage of the product being stuffed past the left ends of the pistons or rams 20 and 21 sealing means, shown generally at 23 in FIGS. 4 and 7 is provided. The sealing means 23 includes an annular two-part seal housing 24 and 18 telescoped over the end of the respective horn 11 or 12 with an "O" ring seal 25 contained in a groove in seal housing 24. If desired a "quad" ring seal will be used in place of the "O" ring 25. A gasket 26 is interposed between the parts of the seal housings 24 and 18, and a clamp assembly 27 of known type which surrounds them and holds the same securely in place.

It is highly desirable that the sealing means 23 be substantially free of sidewise thrust that might be applied thereto by the respective piston or ram 20 or 21 in moving into and out of its horn or housing 11 or 12. For this purpose provision is made for reciprocating rams solely with translatory movement through the intermediary of straight line linkages shown in FIGS. 1, 2, 3, 4, and 6 and designated generally at 29. Since they are identical in construction and application, the same reference characters are applied to both linkages. These linkages are based on mechanical movements known in the prior art.

Each straight line operating linkage 29 includes a pair of operating links 30 that are pivotally connected at their upper ends by a horizontal pivot pin 31 to the left end of each piston or ram 20 or 21. The lower ends of the links 30 are connected by a pivot pin 32 to the distal ends of stiff flexible anchor or support rods 33 that are secured at their other ends 34 to the main frame 10. The distal ends of the rods flex up and down slightly during operation of eack linkage 29. This arrangement permits a necessary slight endwise or longitudinal movement of the links 30 in the operation of the linkage 29.

Each straight line operating linkage 29 also includes a pair of guide links 35 which are pivoted at their upper ends by pivot pins 36 and 37 to vertical members of the main frame 10. The lower ends of the guide links 35 and the mid-points of the operating links 30 are journaled on a pivot pin 38. The pivot pin 38 extends through a hub 39 from which a pitman connecting rod 40 projects to a pivotal connection 41 on a crank arm 42 of a hydraulic actuator shown, generally at 43. It will be observed in FIG. 6 that the crank arms 42 extend in opposite directions on opposite sides of the actuator 43. Thus, when one of the pistons or rams 20 or 21 is forced into the respective horn or ram housing 11 or 12, the other piston or ram is being withdrawn from its horn or ram housing.

The hydraulic actuator 43 may be an article of commerce the details of construction of which do not form a part of this invention. The one shown in the drawings is available from Flo-Tork, Inc. of Orrville, Ohio, Model 15,000. The cranks 42 are pivoted through a semi-circle and cushion means utilizing oil flow through a restricted orifice is employed during the last 15° of pivotal movement in either direction to decelerate the moving parts without subjecting them to shock incident to arresting the movement of the pistons or rams 20 and 21 and the associated linkages at the ends of their strokes. In FIG. 1 the linkage 29 is shown in its condition when the ram 20 is in its extreme retracted or rearward position.

Figure 5:
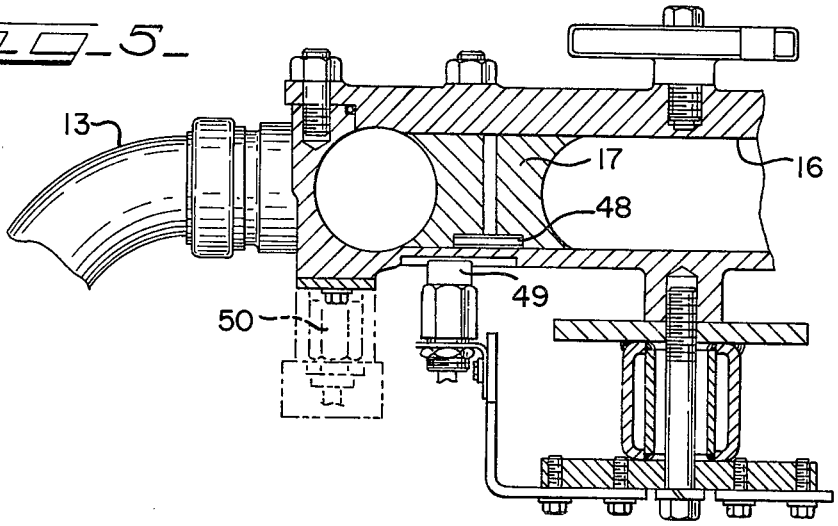
FIG. 5 is a vertical fragmentary sectional view on an enlarged scale taken generally along line 5—5 of FIG. 1.
Figure 6:
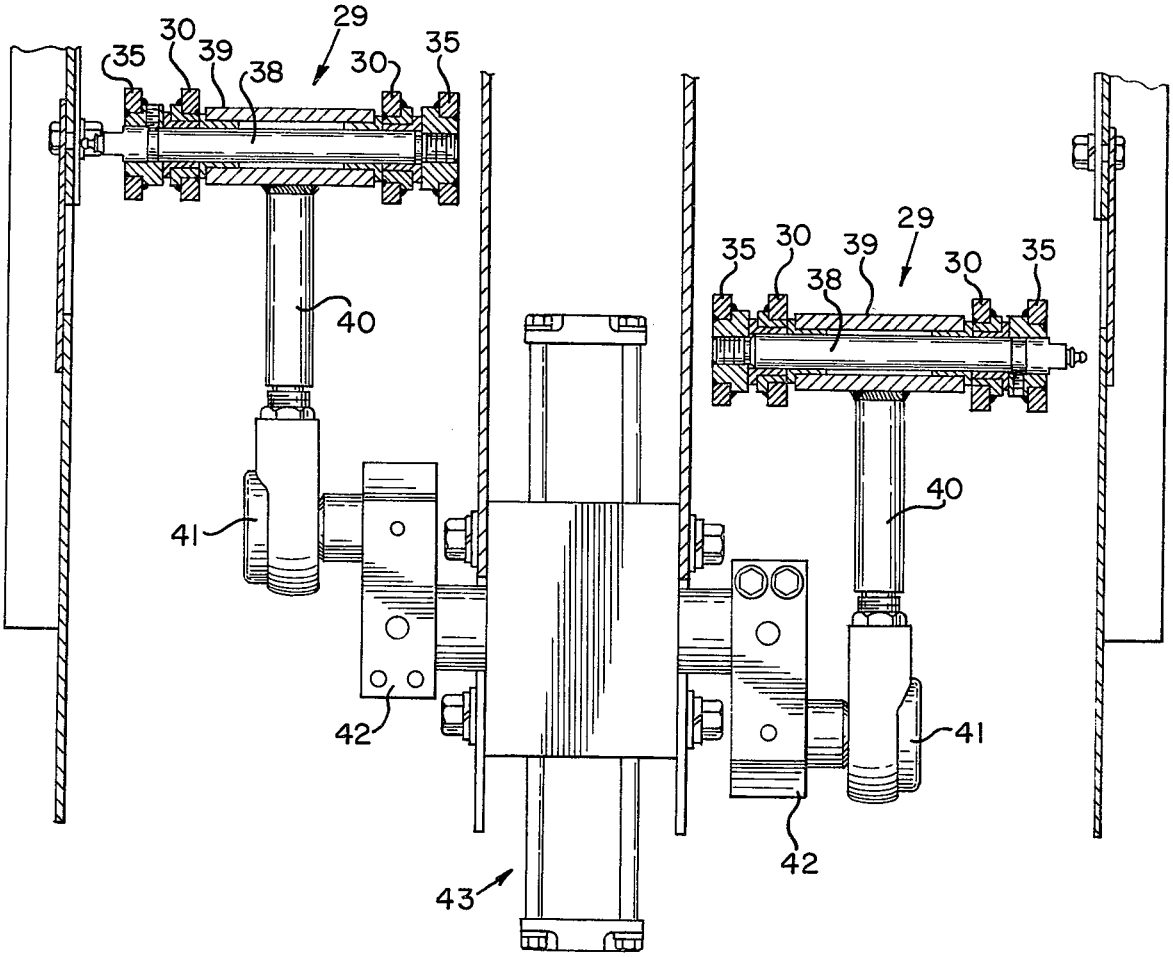
FIG. 6 is a horizontal fragmentary sectional view on an enlarged scale taken generally along line 6—6 of FIG. 2.

As described in the above patent, the operation of the hydraulic operator 43 is controlled by the position of the free piston 17 and by the presence of a container to be filled. For this purpose a ferromagnetic element 48, FIG. 5, is provided in the free piston 17 for cooperation with magnetic sensing elements, one of which is shown at 49 and is carried by the main frame 10. Also, a magnetic sensor 50, carried by the main frame 10, is arranged to cooperate with the application of a container to receive the product as described in the above patent.

In order to confine the pistons or rams 20 and 21 after removal and minimize the danger of their being accidentally dropped, clean-up cages 53 and 54 are mounted endwise thereof on the frame as shown in FIGS. 1 and 2. Each cage 53 and 54 comprises four rods 55 secured in spaced relation by brackets 56 which are suitably mounted on the main frame 10. The rams 20 and 21 can be readily cleaned while confined in their respective cages.

Figure 8:
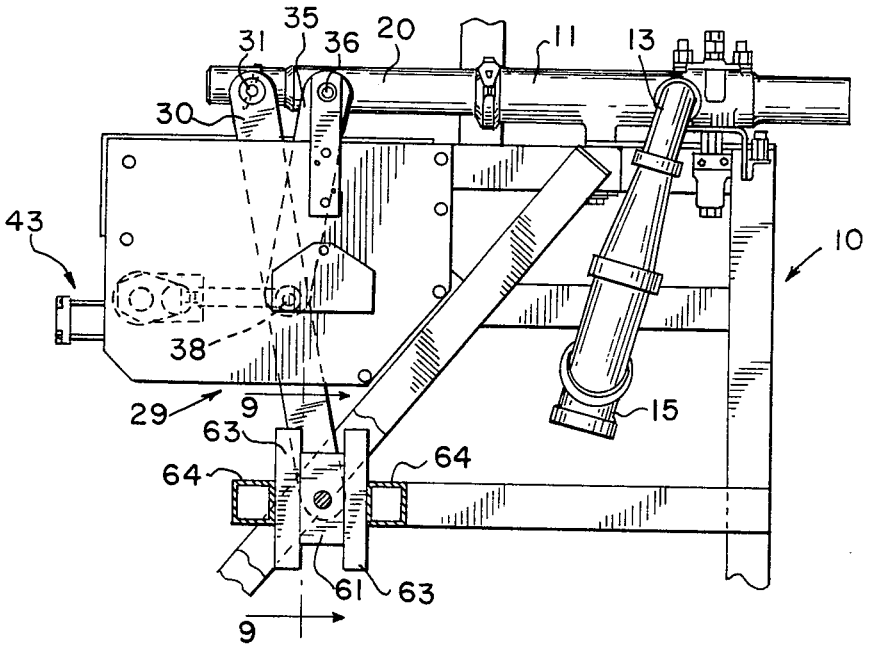
FIG. 8 is a fragmentary side elevational view corresponding to the right hand portion of FIG. 1 and showing a modification.
Figure 9:
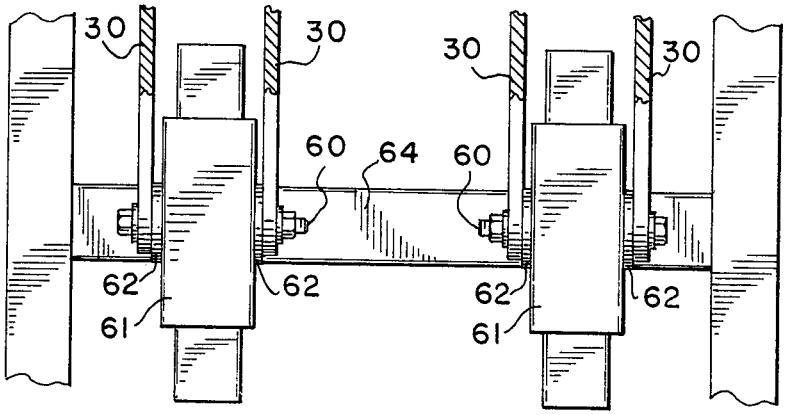
FIG. 9 is a fragmentary detail view taken on line 9—9 of FIG. 8.

Referring to FIGS. 8 and 9 a modification is shown with respect to the anchor means for the lower ends of the operating links 30. In this modification the lower ends of each pair of operating links 30 are interconnected by a pivot pin 60 which passes through a slider block 61. Each slider block 61 is separated from engagement with the lower ends of links 30 by a pair of spacers 62. The movement of each slider block 61 is confined to vertical sliding movement between a pair of front and rear vertical guides 63—63 carried by cross members 64—64 which are in turn carried by the frame 10. This arrangement permits the required endwise movement of the links 30 during the operation of the linkage 29.

I claim:

1. In a volumetric metering stuffer having a ram housing for receiving and transmitting a product intermediate the opposite ends of the ram housing and dispensing the product at one opposite end, and a ram operable in said housing having a product engaging end for engaging a metered quantity of said product within said one opposite end and discharging said metered quantity from said one opposite end of said housing and a driven end slidable into and out of the other opposite end of said housing, the improvement comprising, sealing means at said other opposite end of said housing between said housing and said ram driven end to prevent leakage of said product, and drive means operably connected to said driven end of said ram for translatorily reciprocating said ram along substantially a straight line to prevent application of sidewise thrust on said sealing means, said drive means comprising, a guide link stationarily pivotally mounted at one end, an operating link pivotally connected at one end to said other driven end of said ram, anchor means at the other end of said operating link for permitting endwise movement of said other end, a reciprocating drive mechanism, and means pivotally interconnecting the other end of said guide link and the mid-point of said operating link to said reciprocating drive mechanism.

2. A volumetric metering stuffer according to claim 1 wherein said anchor means comprises flexible anchor rod means stationarily secured at one end, and pivotally connected to and extending generally laterally from said other end of said operating link.

3. A volumetric metering stuffer according to claim 1 wherein said anchor means comprises a slider block pivotally connected to said other end of said operating link and guide means restricting the movement of said slider block to vertical sliding movements.

4. A volumetric metering stuffer according to claim 1 wherein clean-up cage means aligned with said ram is arranged to receive the same when it is withdrawn from said housing.

5. A volumetric metering stuffer according to claim 4 wherein said clean-up cage means comprises a plurality of rods extending laterally and spaced from the surface of said ram for bodily receiving the same therebetween.

* * * * *